United States Patent [19]

Cailloux

[11] 4,031,737

[45] June 28, 1977

[54] MACHINE TOOL APRON GUIDING SYSTEM

[75] Inventor: Paul Cailloux, La Varenne Saint Hilaire, France

[73] Assignee: Promecam Sisson-Lehmann, Saint-Denis, France

[22] Filed: Jan. 14, 1976

[21] Appl. No.: 649,098

[30] Foreign Application Priority Data

Jan. 24, 1975 France ..... 75.02255

[52] U.S. Cl. ..... 72/456

[51] Int. Cl.[2] ..... B21J 13/04

[58] Field of Search ..... 72/456, 455, 385, 386, 72/389; 100/214, 258 A; 83/824, 825

[56] References Cited

UNITED STATES PATENTS 3,007,508 11/1961 Giordano ..... 72/386

3,241,350 3/1966 Giordano ..... 72/455

*Primary Examiner*—C.W. Lanham
*Assistant Examiner*—Gene P. Crosby
*Attorney, Agent, or Firm*—Michael J. Striker

[57] ABSTRACT

A guiding system for the vertically movable apron or table of a machine tool such as a bending press or a shear comprises essentially two sets of rollers disposed in two vertical spaced planes and between vertical races carried by a movable apron and by the fixed frame structure of the machine, and includes tightening mechanism acting in the transverse direction on at least one of the races disposed on either side of one of the sets of rollers to permit clamping of the races against the corresponding rollers and taking up of play in the assembly.

10 Claims, 3 Drawing Figures

MACHINE TOOL APRON GUIDING SYSTEM

BACKGROUND OF THE INVENTION

1. Field of the Invention

This invention is concerned with the guiding of the movable apron or table of a machine tool intended for shaping, bending or shearing sheet metal stock.

2. Description of the Prior Art

At present this guiding action is provided for either by slideways disposed in the end portions of the movable apron or by means of sets of rollers or bearings disposed on either side of the movable apron, one portion of each set being operative for guiding the apron across its main surface and the other portion for guiding the apron laterally.

As a rule, no problem arises from the rollers or bearings disposed for guiding the apron across its major surface, for the efforts and loads developed in this direction are relatively moderate. In contrast thereto, the guide rollers or bearings operating laterally must be dimensioned to withstand high stresses and loads under overhanging conditions, and furthermore they must be as long as possible. Moreover, the length of the races engaged by these rollers or bearings should be slightly greater than the apron stroke. This requirements increases considerably the overall dimensions of the assembly.

Therefore, the present invention is directed to guiding systems of the type wherein independent rollers are interposed between the vertical races carried by the movable apron and the frame structure of the machine, respectively. Systems of this character provide a relatively substantial useful width for guiding the apron, while having a reduced volume. However, in hitherto known systems of this type considerable plays are usually observed which are detrimental to the quality of the guiding action thus obtained. Besides, mounting of the guide rollers is generally unsatisfactory.

SUMMARY OF THE INVENTION

To avoid these various inconveniences, the present invention is directed to a guiding system of this general type wherein two sets of rollers are disposed in two vertical, spaced planes, between vertical races carried by the movable apron and the frame structure of the machine, respectively. In addition clamping means acting in the transverse direction are associated with the races provided on one side of one of the sets of rollers, whereby the races can be tightened against the relevant rollers and play can be taken up.

According to an advantageous form of embodiment of this invention the aforesaid vertical races provided in the space bounded by the two sets of rollers are carried by the movable apron of the machine, and on the inner side of at least one of these sets of rollers the vertical races engaged thereby are formed on wedge members engaging in turn abutments or cam faces carried by a fixed element of the frame structure. Finally, a traction member adapted to cause said pair of wedges to move towards each other is provided for taking up the initial play of the assembly.

According to another feature of the guiding system of this invention two rollers of each set are interconnected by a vertical tie member connected both to the movable apron and to the fixed frame structure through the medium of tackle means comprising each a pair of spaced pulleys rotatably mounted on the corresponding tie member and engaged by a rope of which one run is anchored to the apron and the other to an element of said frame structure.

However, other features and advantages of the guiding system of this invention will appear as the following description proceeds with reference to the attached drawing illustrating diagrammatically by way of example a typical form of embodiment thereof. In the drawing:

DESCRIPTION OF THE PREFERRED EMBODIMENT

Figure 1:
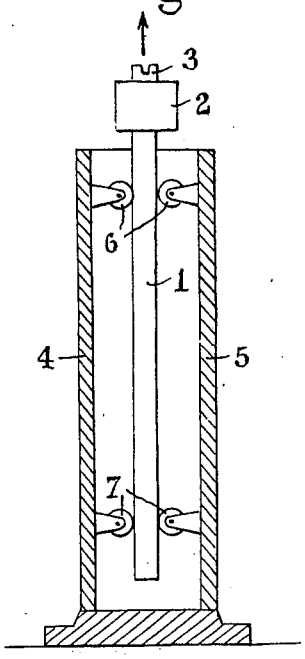
Fig.1 PRIOR ART
FIG. 1 is a vertical section showing the lower portion of the frame structure of a machine tool comprising a movable apron.
Figure 3:
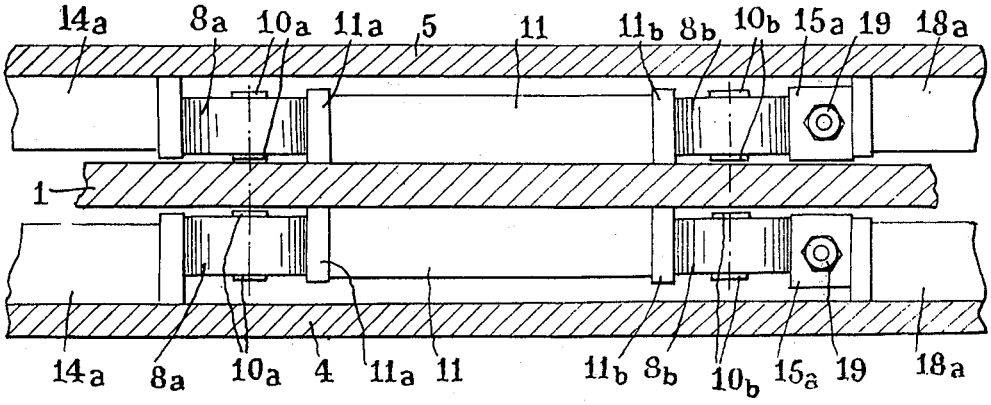
FIG. 3 is a plan view from above of this movable apron and of the lateral guide means associated therewith.

As mentioned hereinabove, FIG. 1 shows in vertical section taken along a transverse plane the lower portion of the frame structure of a machine tool comprising an apron or movable element 1 adapted to travel in a straight line in the vertical direction for performing a shaping or shearing operation on a sheet metal blank. This movable apron may consist for example of the upper or lower apron of a bending press. If the apron is the lower one, it carries at its upper portion a horizontal beam 2 supporting a shaping die 3. This apron is mounted between a pair of vertical plates 4 and 5 forming an integral part of the frame structure. The inner surfaces of these plates carry several pairs of rollers 6 and 7 adapted to guide the apron in the vertical direction. However, this is a well-known guiding system without any specific feature.

The guiding device of this invention is intended on the other hand for guiding the apron in the lateral direction and therefore, it is designed to withstand the relatively heavy loads and efforts which will be exerted under overhanging conditions on this apron.

This device is double and comprises on either side of the apron 1 two sets or trains of rollers **8*a*, 9*a* on the one hand and 8*b*, 9*b* on the other hand, with the roller axes extending at right angles to the apron. The two rollers of each set are interconnected by respective vertical tie members designated by the reference numerals 10*a* and 10*b*. These two sets of rollers are disposed in two vertical planes XX′ on the one hand and YY′ on the other hand, which are somewhat spaced from each other. Thus, the upper rollers 8*a* and 8*b* of each set of rollers are located at a relatively great distance from the lower rollers 9*a* and 9*b***.

These two sets of rollers are both independent of the movable apron 1 and of the adjacent vertical plate 4 or 5 of the fixed frame structure of the machine. However, on one side, each roller engages a vertical race-forming surface **11*a*, 12*a*, 12*b* or 11*b* rigid with the corresponding face of said movable apron 1, each such vertical surface extending in a plane perpendicular to the adjacent apron face. On the opposite side, each roller engages another vertical race which is fixed. This last-mentioned race is carried in fact by the inner surface of the adjacent plate 4 or 5 of the frame structure of the machine, and extends likewise at right angles to the adjacent face of plate 4 or 5**. Thus, each roller is interposed between two vertical races, i.e. a fixed race and a movable race, both parallel to the roller axes.

Preferably, the races carried by the movable apron are disposed in the space bounded by the two sets of rollers and consist advantageously of wear-resistant plates of very hard material, disposed at the ends of the two blocks 11 and 12, respectively, rigid with the relevant face of apron 1.

The races proper consist on one side of a pair of wear-resistant plates 13*a* and 13*b* carried by blocks 14*a* and 14*b* rigid with the inner surface of the corresponding plate 14*a* and 14*b* of the frame structure. On the opposite side the fixed races engaged by the corresponding rollers 8*a* and 9*b* consist of vertical surfaces of a pair of wedge members 15*a* and 15*b* of very hard material. These two wedge members are interconnected by a tie rod 16 and engage a pair of cam faces or ramps 17*a* and 17*b* carried by a pair of fixed blocks 18*a* and 18*b* on the inner surface of the corresponding plate 4 or 5 of the frame structure. The end portions of said tie rods 16 are secured to the wedge members 15*a* and 15*b*, and one of them carries a nut 19 for clamping or tightening the assembly and taking up play.

Figure 2:
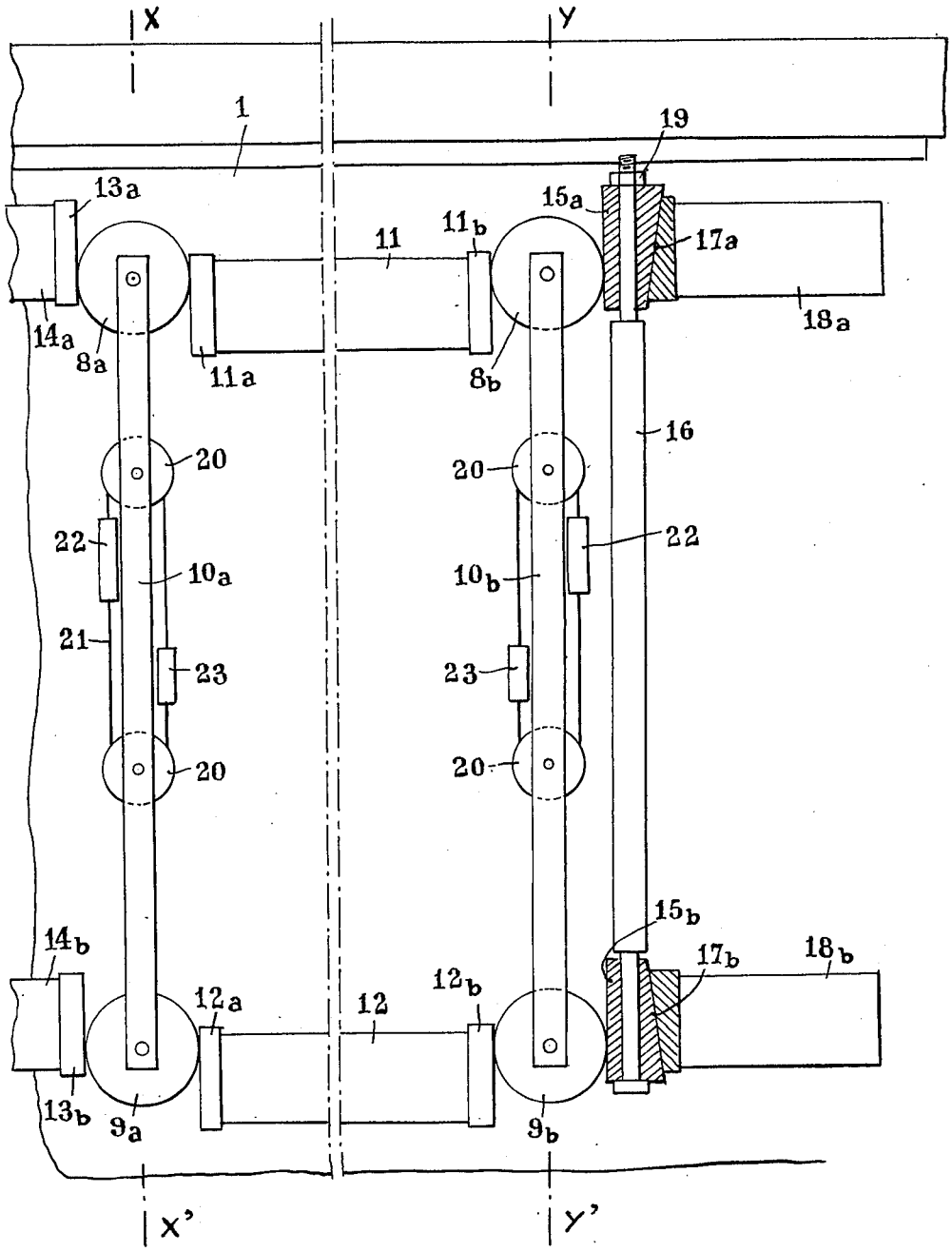
FIG. 2 is a fragmentary front elevational view of the movable apron of FIG. 1 with the guide system of this invention.

Each set of rollers is connected both to the movable apron and to the fixed frame structure of the machine through means capable of allowing a certain linear movement of the set involved, which corresponds to one-half of the movement accomplished by the movable apron. In the example illustrated in FIG. 2 these connecting means consist of a pair of pulleys 20 over which an endless rope 21 is passed. One of the runs of this rope is attached to a fastening member 22 rigid with the corresponding plate 4 or 5 of the fixed frame structure. The other run of the rope 21 is attached similarly to a fastening member 23 carried by the relevant face of the movable apron 1. This assembly constitutes a tackle enabling each set of rollers to perform a linear movement corresponding to about one-half of the movement accomplished by the movable apron.

In fact, when the apron moves vertically, the rollers engage both fixed races and movable races, so that their centers travel through a distance corresponding to one-half of the travel accomplished by the movable apron itself. The length of these vertical race surfaces may consequently be only equal to or slightly greater than one-half of the apron stroke.

However, the main advantage of the guiding system of this invention lies in the provision of tightening means acting in the transverse direction and associated with the race surfaces formed on one of the sides of one of the sets of rollers to permit the clamping or tightening of the races between the corresponding rollers and also the taking up of the initial plays.

Now this essential feature of the present invention is of primary importance for achieving the desired result, i.e. a perfect guiding of the movable apron during its vertical movement. In fact, the arrangement thus contemplated permits taking up any initial play and imparts a suitable pressure to the races between the corresponding rollers by prestressing the component elements of the device of this invention.

After prestressing, both sets of rollers are prefectly retained between the two sets of corresponding races, and therefore are not liable to fall due to their inherent weight. Consequently, it is only for the sake of additional safety useful notably before the taking up of the initial play that connecting means have been provided between the tie members of the rollers of each set, and between the movable apron, on the one hand, and the fixed frame structure, on the other hand.

In this respect it may be emphasized that due to the specific design of the connecting means contemplated in the above-described example the pulleys 20 travel through the same distance as the guide rollers. Consequently, the movement of the movable assembly comprising the rollers, tie members, pulleys and ropes is perfectly proportional to the apron movement but in the ratio of 1:2.

However, the connecting means associated with each set of rollers may differ from those contemplated in the above-described example, provided that they permit movement of the sets of rollers in the 1:2 ratio with respect to the movement of the movable apron.

As already explained in the foregoing, the present guiding device is suitable for use on machine tools comprising a movable table or apron travelling vertically in relation to the frame structure of the machine, for example in bending or folding presses or shears. However, it will readily occur to those conversant with the art that various modifications may be brought to the forms of embodiment shown, described and/or suggested herein, without departing from the basic principle of the invention as set forth in the appended claims.

What is claimed as new is:

1. In a machine tool such as a press or a shear, comprising a vertical apron movable in the vertical direction in relation to the fixed frame structure of the machine, means for guiding said apron in the longitudinal direction during its vertical movements, said means comprising on each face of said movable apron:

two pairs of vertical races rigid with said fixed frame structure and extending at right angles to the corresponding face of said movable apron, the two races of one of said pairs registering with two races of one of two pairs of races carried by said movable apron to form a first group of races, said other two races carried by said movable apron forming with said two races of said other pair of races rigid with said fixed frame a second group of races;

two pairs of rollers disposed in two spaced vertical planes respectively between the races of said first and second groups which are in part rigid with the movable apron and in part rigid with said fixed frame structure, respectively, and tightening means adapted to produce a horizontal pressure for clamping at least some of said vertical races against the corresponding rollers, said tightening means being associated with the races formed on one side of one of said pairs of rollers.

2. A machine tool as set forth in claim 1, wherein the vertical races formed in the space bounded by the two sets of rollers are carried by said movable apron, the vertical races disposed on the outer side of at least one of said two sets of rollers being formed on wedge members co-acting with cam faces carried by a fixed element of said frame structure, a traction member constantly urging said wedge members towards each other for taking up the initial plays of the assembly.

3. A machine tool as set forth in claim 2, wherein each set of rollers comprises two rollers assembled by means of a vertical tie member attached to said movable apron and to said fixed frame structure through tackle means comprising each a pair of spaced pulleys rotatably mounted on the corresponding tie member and an endless rope passing over said pulleys, said rope being attached through one run to said movable apron and through the other run to a component element of said frame structure.

4. In combination with a machine having a fixed frame and an element movable in a straight line relative to said frame, a guide system comprising:

a pair of formations on said element forming a pair of oppositely facing planar surfaces parallel to each other and to said straight line;

a pair of formations on said frame forming a pair of confronting planar surfaces parallel to each other and to said straight line and each confronting a respective one of said surfaces of said element;

a pair of rollers each having one side bearing on a respective one of said surfaces of said frame and another side bearing on the confronting surface of said element, each roller being rotatable about a respective axis parallel to the respective surfaces and so oriented that on displacement of said element along said line relative to said frame each roller rolls on its respective surfaces; and means for displacing one of said surfaces of said frame toward the other of said surfaces of said frame in a direction transverse to said straight line.

5. The combination defined in claim 4 wherein said straight line is vertical.

6. The combination defined in claim 4, further comprising means for displacing each of said rollers at a speed equal to substantially half the speed of displacement of said element on said frame on such displacement of said element on said frame.

7. The combination defined in claim 4, further comprising a second such pair of formations on said element spaced thereon in the direction of said line from the first-mentioned pair of such formations on said element; a second such pair of formations on said frame confronting and parallel to the second pair of formations on said element; and a second such pair of rollers between each of said formations of said second pair on said frame and the corresponding surface on said element, said means being connected to one of said formations of said second pair on said frame for displacing the corresponding surface toward the other surface of the respective pair.

8. The combination defined in claim 7, further comprising a tie member connected between each of the first-mentioned rollers and the one of said second pair of rollers on the same side of said straight line, each tie member rigidly connecting the respective rollers together for joint movement in the direction of said straight line.

9. The combination defined in claim 4, wherein said means includes an abutment on said frame and a wedge block engaged between said abutment and said formation constituting said one surface.

10. The combination defined in claim 9 wherein said means includes means for displacing said wedge block in a direction parallel to said straight line.

* * * * *